United States Patent [19]

Udo Hafner

[11] Patent Number: 5,044,339

[45] Date of Patent: Sep. 3, 1991

[54] FUEL INJECTION SYSTEM FOR INTERNAL COMBUSTION ENGINES

[75] Inventor: Udo Hafner, Ludwigsburg, Fed. Rep. of Germany

[73] Assignee: Robert Bosch GmbH, Stuttgart, Fed. Rep. of Germany

[21] Appl. No.: 463,576

[22] Filed: Jan. 11, 1990

[30] Foreign Application Priority Data

Mar. 11, 1989 [DE] Fed. Rep. of Germany ..... 3907972

[51] Int. Cl.[5] ..... F02M 41/00

[52] U.S. Cl. ..... 123/456; 123/470; 123/41.31

[58] Field of Search ..... 123/470, 472, 456, 41.31, 123/468, 469, 516; 239/600, 585

[56] References Cited

U.S. PATENT DOCUMENTS

| | | | |
|---|---|---|---|
| 3,125,078 | 3/1964 | Reiners | 123/470 |
| 3,608,531 | 9/1971 | Baxendale . | |
| 4,395,988 | 8/1983 | Knapp | 123/469 |
| 4,601,275 | 7/1986 | Weinand . | |
| 4,660,531 | 4/1987 | Lauterbach | 123/456 |
| 4,844,036 | 7/1989 | Bassaer | 123/468 |
| 4,845,748 | 11/1974 | Eisenberg | 123/470 |
| 4,934,329 | 6/1990 | Lear | 123/456 |

FOREIGN PATENT DOCUMENTS

| | | | |
|---|---|---|---|
| 3705848 | 9/1988 | Fed. Rep. of Germany . | |
| 0035071 | 2/1989 | Japan | 123/469 |

*Primary Examiner*—Carl Stuart Miller

*Attorney, Agent, or Firm*—Edwin E. Greigg; Ronald E. Greigg

[57] ABSTRACT

A fuel injection system for an internal combustion engine having a fuel supply line and at least one electromagnetically actuated fuel injection valve for metering a fuel injection quantity, which valve includes a mouthpiece fitting embodied on the valve body which protrudes into an opening in an intake tube of the engine, and the end remote from the mouthpiece fitting communicates via a fuel inflow opening with the fuel supply line. To meet hot-start conditions of the engine, the valve body is surrounded by a sheath and between the sheath and the valve body an annular chamber is formed, which extends over a substantial portion of the axial length of the valve body. Via one inflow and one outflow opening, the annular chamber is incorporated into the fuel flow in the fuel supply line.

8 Claims, 2 Drawing Sheets

FUEL INJECTION SYSTEM FOR INTERNAL COMBUSTION ENGINES

BACKGROUND OF THE INVENTION

The invention relates to a fuel injection system for internal combustion engines of the type defined herein.

In such fuel injection systems, the entire valve body of the fuel injection valve, protruding only with its mouthpiece fitting into the intake tube immediately upstream of the inlet valve in the cylinder head of the engine, is located in the immediate vicinity of the engine and thus, when the engine is being shut off, for instance, the mouthpiece fitting is exposed to pronounced thermal radiation, which also heats the fuel in the fuel injection valve. This produces vapor bubbles in the interior of the fuel injection valve. The bubbles rise and some of them are retained in the fuel filter, which with its close mesh acts as a barrier to the vapor bubbles. During this phase, evaporated fuel is thus present in the lower region of the fuel injection valve. If starting of the engine is undertaken in this hot phase (hot starting), then the evaporated fuel is sufficient for quick starting. Since the vapor bubbles in the upper region of the fuel injection valve reach the metering zone by way of the upwardly flowing fresh fuel, and the fresh fuel also evaporates at the hot surface of the valve body, the outcome is a marked reduction in the quantity of fuel injected and thus an attendant reduction in the rpm of the engine, possibly to the extent of stopping it.

In a fuel injection system (German Patent 37 05 848 Al), U.S. Patent application Ser. No. 134,718 filed Dec. 18, 1987, to avoid this disadvantage, each fuel injection valve is inserted into a cylindrical valve receptacle, which has an annular groove for inflowing fuel and, axially spaced apart from it, an annular groove for returning fuel. A radial inflow opening in the valve body connects the annular fuel inflow groove to the valve chamber, and a radial outflow opening connects the valve chamber to the annular fuel return groove. The fuel supply line coming from the fuel tank opens into the annular fuel inflow groove of the first fuel injection valve, while the annular fuel inflow groove of each further fuel injection valve communicates with the annular fuel return groove of the preceding fuel injection valve. The fuel return line that leads back to the fuel tank is connected to the annular fuel return groove of the final fuel injection valve. If "hot" starting is performed in this known fuel injection system, the fuel injection valves are rapidly and compulsorily flushed, so that any fuel vapor that may be present is flushed out of the fuel injection valves away from the valve seat, and rapid cooling of the fuel injection valves with fresh fuel assures the required fuel supply to the engine, so that the started engine continues to run unimpeded. A disadvantage of such a fuel injection system, which has so-called "side-feed" valves, is the substantially higher production price compared with the "top-feed" valves described at the outset, because of the substantially more expensive machining of the valve body that is required.

OBJECT AND SUMMARY OF THE INVENTION

The fuel injection system according to the invention has an advantage over the prior art of using top-feed valves while meeting the required hot-start conditions of the kind typically attainable only with side-feed valves, and of doing so at substantially lower production costs compared with fuel injection systems having side-feed valves. Prior to the engine shutoff phase, the continuous cooling of the valve body with fuel in the vicinity of the annular chamber between the sheath and the valve body lowers the temperature level of the fuel injection valve. As a result, the attainable maximum temperature in the shutoff phase of the engine is already lower. In starting of the engine in the hot shutoff phase (hot starting), the valve body of the fuel injection valve is immediately cooled on its entire surface. This means that fuel located in the fuel injection valve cools down with a corresponding time lag, or vapor bubbles condense and become fuel once again. The engine started in the hot phase continues to run without disruption.

As additional provisions for converting the top-feed valve to a cooled top-feed valve, one sheath and two 0-rings for sealing off the fuel injection valve in the sheath are necessary. The conventional fuel supply to the fuel injection valve is maintained; the sheath is incorporated in the fuel return. The production cost is less than when, side-feed valves are used.

Advantageous further features and improvements to the fuel injection system defined herein are possible with the provisions set forth.

Since at least four fuel injection valves are typically needed for one engine, their sheaths are advantageously combined into one joint housing body, in a preferred exemplary embodiment of the invention. This housing body receives stepped receiving bores for the individual fuel injection valves, which are made to communicate with one another by a longitudinally continuous connecting bore. The connecting bore discharges at one end in connection fittings for the fuel line. 0-rings between the valve body of the fuel injection valve inserted into the receiving bore and the bore wall of the receiving bore create the annular chamber for cooling of the valve body in a simple manner, without entailing high production costs. The housing body is inserted with its connection fitting into the return portion of the fuel supply line that communicates with the fuel tank, so that the fuel distributor that is typical for the fuel injection system having top-feed valves can be retained without change for supplying fuel to the fuel injection valves.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
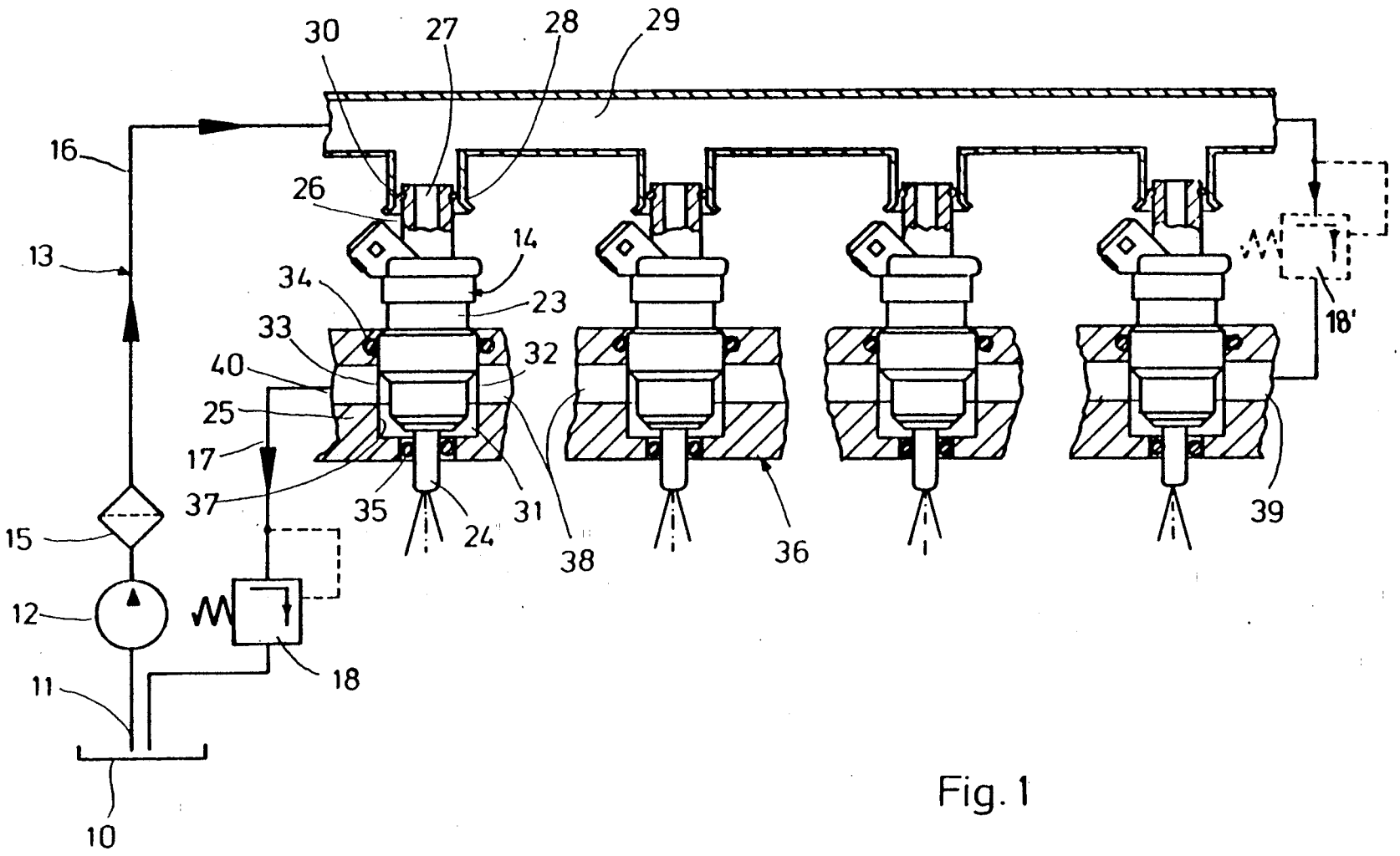
FIG. 1 is a schematic view of a fuel injection system for an internal combustion engine, shown partly in section.

In the fuel injection system for an internal combustion engine schematically shown in FIG. 1, a fuel tank 10 is shown, from which, a fuel pump 12 pumps fuel via a feed fitting 11 into a fuel supply line 13. The fuel supply line 13 serves to supply fuel to electromagnetically actuatable fuel injection valves 14 and comprises a feed line portion 16 between the fuel pump 12 and the fuel injection valves 14 and a return line portion 17 between the fuel injection valves 14 and the fuel tank 10. A fuel filter 15 is disposed in the feed line portion 16, and a pressure regulating valve 18 is disposed in the return line portion 17.

Figure 2:
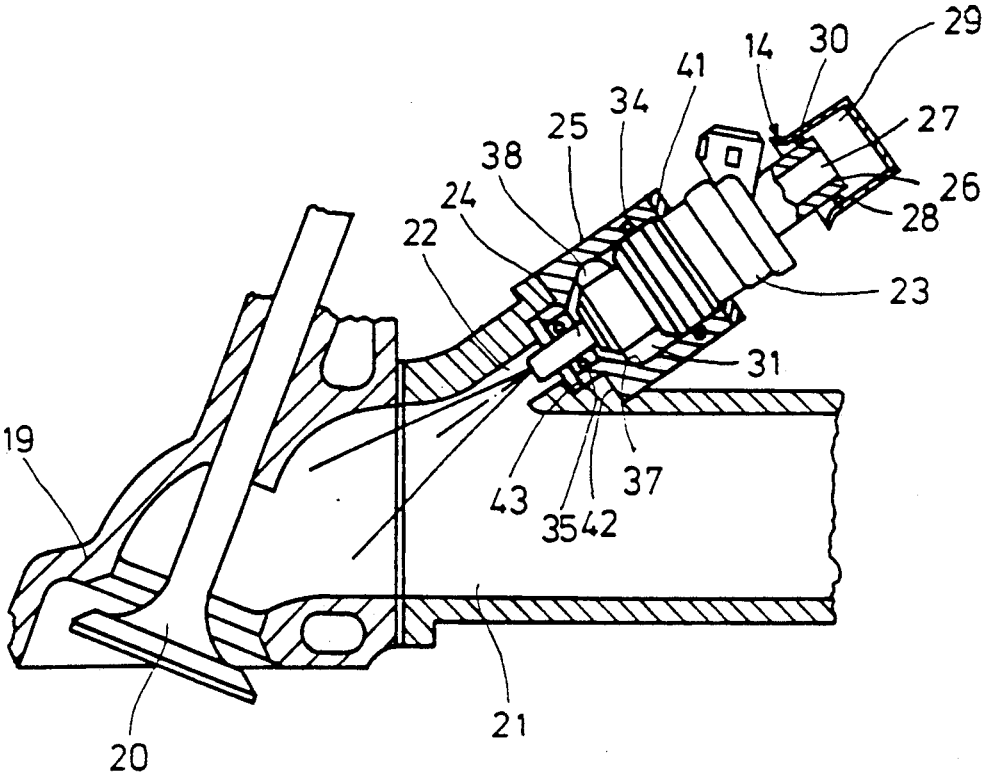
FIG. 2 is a detail in cross section of one fuel injection valve of the fuel injection system of FIG. 1, in the vicinity of the intake tube and cylinder head of the engine.

The fuel injection valves 14 are disposed on individual intake tubes 21 shown in FIG. 1 for each cylinder of the engine, directly upstream of the inlet valve 20. FIG. 2 shows the disposition of a fuel injection valve 14 in a sheath 25 shown in cross section. The inlet valve 20 is disposed in the cylinder head 19 of the engine. The individual intake tube 21 leads to the engine valve inlet and immediately upstream of the engine valve inlet has an opening 22; the fuel injection valve 14 protrudes into this opening 22 with a mouthpiece fitting 24, formed onto the valve body 23, for the injection of fuel. All of the fuel injection valves 14 are in the form of so-called top-feed valves; that is, they are supplied with fuel on their end remote from the mouthpiece fitting 24. To this end, each fuel injection valve 14 is provided with an inflow fitting 26, which has a coaxial inflow opening 27 communicating with the fuel injection valve chamber in the interior of the valve body 23, the inflow fitting 26 is inserted into a respective connection fitting 28 of a fuel distributor 29, 0-rings 30 provide fluid sealing. The fuel distributor 29 is connected to the fuel supply line 13 between the feed line portion 16 and the return portion 17.

For cooling of the fuel injection valves 14, each valve body 23 is surrounded by a sheath 25, and between this sheath 25 and the valve body 23 an annular chamber 31 remains, which extends from the mouthpiece fitting 24 over a considerable portion of the axial length of the valve body 23. This annular chamber 31 communicates with an inflow opening 32 and an outflow opening 33 in the sheath 25. Two O-rings 34, 35 above and below the annular chamber 31 seal the valve body 23 against fuel leakage in the radial direction from the inner wall of the sheath 25. The inflow opening 32 and outflow opening 33 are incorporated into the return portion 17 of the fuel supply line 13, so that fuel flowing in the fuel supply line 13 flows through the annular chamber 31.

With the four fuel injection valves 14 required for a four-cylinder engine, it is suitable to combine the sheath 25 of the various fuel injection valves 14 into a one-piece component. As schematically sketched in FIG. 1, this combination is made in such a way that a number of through bores 37, corresponding to the number of fuel injection valves 14, is provided in an elongated housing body 36, one bore for receiving each fuel injection valve 14. All the through bores 37 communicate with one another via an axial connecting bore 38. The connecting bore 38 receives fuel via fitting 39 at one end and discharges into connection fitting 40 with which the housing body 36 is connected with the return line portion 17 of the fuel supply line 13 Each through bore 37 is stepped, and the diameter of the portion having the larger diameter is slightly larger than the largest diameter of the valve body 23, while the diameter of the portion of the bore having the smaller diameter is slightly larger than the outside diameter of the mouthpiece fitting 24. The O-rings 34 and 35 seal the valve body 23 and the mouthpiece fitting 24, respectively, from the bore wall. The inflow openings 32 and outflow openings 33 ar embodied by the mouths of the connecting bore 38 into the through bores 37. Each inflow opening 32 thus communicates via the connecting bore 3 with the outflow openings 33 of the adjacent fuel injection valve 14 preceding it in the direction of fuel flow. All the fuel injection valves 14 are firmly fastened in the through bores 37 by means of a holder, shown at 41 in FIG. 2. The entire housing body 36 rests with its underside on bearing flanges 42 on the individual intake tubes 21 and can, as shown in FIG. 2, protrude into the individual intake tubes 21 with centering fittings 43 that are coaxial with the through bores 37, each fitting 43 protruding into one opening 22.

The pressure regulating valve 18 disposed in the return line portion 17 in FIG. 1 adjoins the connection fitting 40 that begins at the housing body 36. It may be advantageous if instead, a pressure regulating valve 18' shown in dashed lines in FIG. 1 be included in the line portion leading from the fuel distributor 29 to the connection fitting 39. This has the advantage that the O-rings 34, 35 no longer need to meet such stringent sealing requirements. The prevailing pressure is no longer as high, so the fuel pressure load on the O-rings 34, 35 is reduced.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection system for internal combustion engines, having a fuel supply line (13) and a plurality of electromagnetically actuated fuel injection valves (14), each of which meter a fuel injection quantity into an intake tube of an engine, each of said plurality of valves includes a mouthpiece fitting embodied on a face end of a valve body which mouthpiece fitting protrudes into an opening in the intake tube of the engine, and communicates with the fuel supply line via a fuel inflow disposed on an upper end of said fuel injection valve remote from the mouthpiece fitting, a sheath (25) surrounding said fuel injection valve body (23), an annular chamber (31) formed between said sheath and said valve body and extending approximately from said mouthpiece fitting (24) over a substantial portion of an axial length of said valve body (23), and that via an inflow opening (32) and an outflow opening (33) which communicate with the annular chamber (31), the sheath (25) is incorporated into the fuel supply line (13), and said fuel supply line (13) is embodied such that it communicates downstream of an inflow neck (26) of one of said injection valves with the annular chambers (31) of each of said fuel injection valves.

2. A system as defined in claim 1, in which said valve body (23) is sealed off radially on an inner wall of the sheath (25) above and below the annular chamber (31) via respective O-ring (34).

3. A system as defined by claim 1, in which said fuel supply line (13) has a feed line portion (16) extending from a fuel tank (10) as far as the at least one fuel injection valve (14) and a return line portion (17) adjoins the feed line portion and extends from at least one fuel injection valve (14) to the fuel tank (10), and that the sheath (25) is disposed in the return portion (17) of the fuel supply line (13).

4. A system as defined by claim 2, in which said fuel supply line (13) has a feed line portion (16) extending from a fuel tank (10) as far as the at least one fuel injection valve (14) and a return line portion (17) adjoins the feed line potion and extends from at least one fuel injection valve (14) to the fuel tank (10), and that the sheath

(25) is disposed in the return portion (17) of the fuel supply line (13).

5. A system as defined by claim 3, in which said plurality of fuel injection valves (14), and plurality of individual sheaths (25) in the fuel flow direction are disposed successively in the return line portion (17) of the fuel supply line (13) in such a way that the inflow openings (32) of the sheaths (25) succeeding one another in the flow direction communicate with the outflow openings (33) of the respective proceeding sheaths (25), while the inflow openings (27) of the upper end of the fuel injection valves (14) are connected to the feed line portion (16) of the fuel supply line (13) in parallel with one another.

6. A system as defined by claim 4, in which said plurality of fuel injection valves (14), and plurality of individual sheaths (25) in the fuel flow direction are disposed successively in the return line portion (17) of the fuel supply line (13) in such a way that the inflow openings (32) of the sheaths (25) succeeding one another in the flow direction communicate with the outflow openings (33) of the respective proceeding sheaths (25), while the inflow openings (27) of the upper end of the fuel injection valves (14) are connected to the feed line portion (16) of the fuel supply line (13) in parallel with one another.

7. A system as defined by claim 5, in which each of said sheaths (25) of said plurality of fuel injection valves (14) are combined in such a way that a number of stepped through bores (37) corresponding to the number of fuel injection valves (14), each for receiving one fuel injection valve (14) are provided in an elongated housing body (36), the through bores communicating with one another via an axial connecting bore (38) intersecting with all the through bores (37), and the connecting bore (38) discharges at its end into connection fittings (39, 40) for insertion into the return portion (17) of the fuel supply line (13).

8. A system as defined by claim 6, in which each of said sheaths (25) of said plurality of fuel injection valves (14) are combined in such a way that a number of stepped through bores (37) corresponding to the number of fuel injection valves (14), each for receiving one fuel injection valve (14) are provided in an elongated housing body (36), the through bores communicating with one another via an axial connecting bore (38) intersecting with all the through bores (37), and the connecting bore (38) discharges at its end into connection fittings (39, 40) for insertion into the return portion (17) of the fuel supply line (13).

* * * * *